United States Patent [19]

Choi

[11] Patent Number: 4,844,508

[45] Date of Patent: Jul. 4, 1989

[54] ALBUM BINDING DEVICE AND METHOD OF BINDING

[76] Inventor: Harry Y. Choi, C.P.O. Box 4149, Seoul, Rep. of Korea

[21] Appl. No.: 107,652

[22] Filed: Oct. 9, 1987

[51] Int. Cl.[4] ..... B42D 1/00; B42D 3/18; B42F 13/02; B65D 27/00

[52] U.S. Cl. ..... 281/15.1; 281/51; 402/79; 40/359

[58] Field of Search ..... 281/1, 3, 15 R; 282/1, 282/2, 8, 22; 283/63; 402/79; 40/152, 359, 360

[56] References Cited

U.S. PATENT DOCUMENTS

| | | | |
|---|---|---|---|
| 1,306,691 | 6/1919 | Goetz | 281/5 |
| 3,206,225 | 9/1965 | Oleson | 412/3 |
| 3,664,912 | 5/1972 | Olson | 281/15 R |
| 3,895,453 | 7/1975 | Wright | 402/79 |
| 4,577,889 | 3/1986 | Schulz | 281/1 |
| 4,703,952 | 11/1987 | Biasini | 281/15 R |
| 4,706,396 | 11/1987 | Nomura | 40/359 |

*Primary Examiner*—Frank T. Yost
*Assistant Examiner*—Paul M. Heyrana, Sr.

[57] ABSTRACT

An album which includes a cover, a binder element and leaves wherein the binder element is attached to the spine of the cover and the leaves are fused to the binder.

2 Claims, 4 Drawing Sheets

ALBUM BINDING DEVICE AND METHOD OF BINDING

BACKGROUND OF THE INVENTION

1. Field of the Invention

The present invention relates to the art of binding leaves of an album, such as a photograph album, to the album cover. More particularly, the present invention is directed to an album of the type in which leaves are fused to a binder element which is attached to the spine of the cover.

2. Description of the Related Art

A photograph album typically has an album cover to which are attached leaves on which photographs are attached for display. The leaves in some previously known photograph albums are made of sheets of cardboard which are attached by hinges to the spine of the album cover. The hinges allow the leaves to be turned.

As shown in FIG. 1, one method of binding cardboard leaves to the spine of the album cover includes the steps of riveting a metal ring binder element to the spine of the album cover and attaching the cardboard leaves to the rings of the binder element. An album 10 is shown in which cardboard display leaves 12 are held together by rings 14 of a ring binder element 16. The ring binder element 16 is attached to the spine 18 of album cover 20 with rivets 22. Alternatively, referring to FIG. 2, an album is shown in which the album cover does not have a spine. Cardboard display leaves 24 are held between front cover flap 26 and back cover flap 28 by ring 30.

Some photograph albums are of the type in which the leaves are transparent plastic, and are in the form of pockets for holding photographs. An example of such pocket type leaves 50 having openings 58 is shown in FIGS. 3 and 4. Typically, the pocket type leaves or "pockets" are attached to a metal binder element as in the case of the cardboard leaves in FIG. 1.

The albums shown in FIGS. 1 and 2, however, are subject to certain limitations and drawbacks. The metal ring binder elements are typically bulky in size, and cause the resulting album not to resemble that of a bound book which has been found to be undesirable when the album is shelved next to bound books. Moreover, the binder elements described above are expensive to manufacture. In addition, for the album shown in FIG. 1, its external appearance is blemished by the presence of rivets 22 showing on the surface of the spine 18.

SUMMARY OF THE INVENTION

The present invention is directed to an album which includes a cover, a binder element and leaves pivotally fused to the binder element. A portion of the binder element and the portions of the leaves attached to said binder element portion comprise fusible material. The leaf portions are fused to the binder element portion by application of heat and/or pressure. The binder element is attached to the spine of an album cover to form an album which is durable, inexpensive and simple to manufacture, and which appears as a typical bound book.

BRIEF DESCRIPTION OF THE DRAWINGS

The invention will be described with reference to the accompanying drawings wherein.

DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 3:
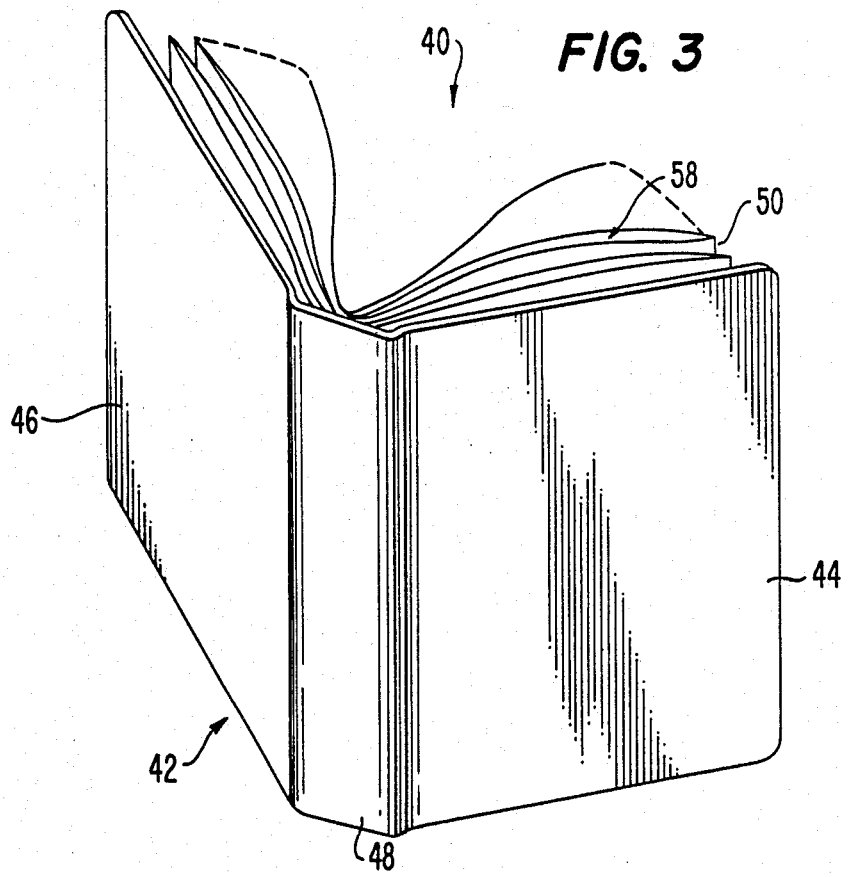
FIG. 3 is a perspective external view of one embodiment of an album of the present invention.
Figure 4:
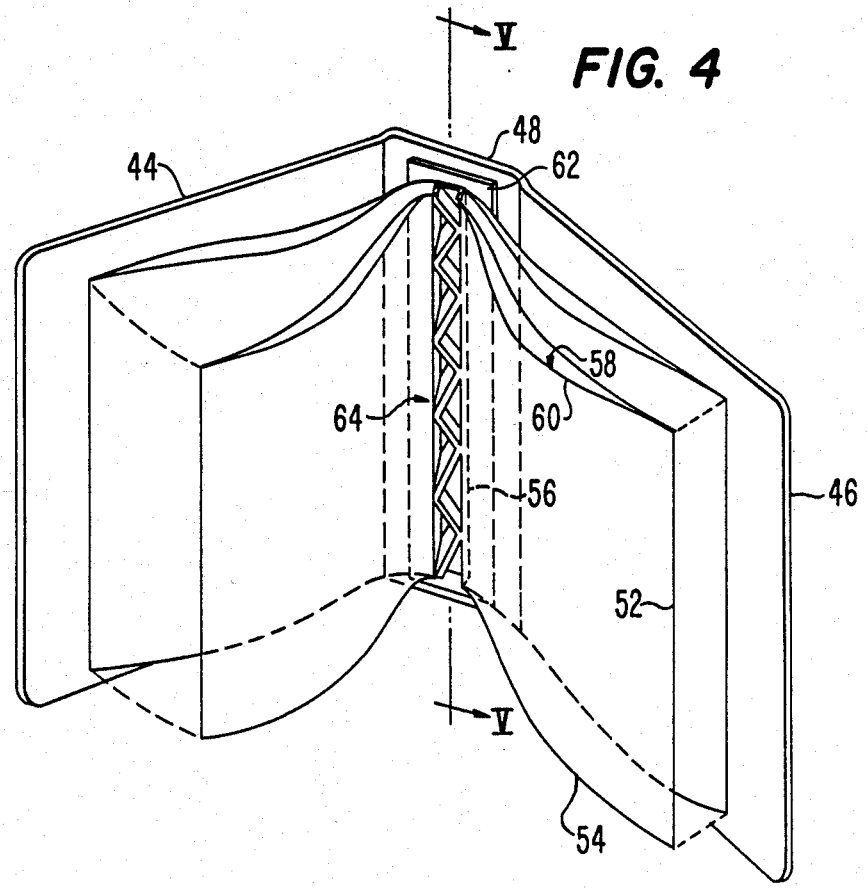
FIG. 4 is a perspective internal view of one embodiment of the album.

FIGS. 3 and 4 illustrate the general appearance of an album 40 according to a preferred embodiment of the present invention. For convenience, the present invention will be described with reference to a photograph album of the type in which photographs are contained in pocket type leaves (hereinafter "pockets") of the album. However, the present invention may be implemented as an album for making collections of other kinds of articles without departing from the scope and spirit of the present invention. In addition, the leaves need not necessarily be pockets.

The photograph album 40 generally includes album cover 42 including front and back flaps 44 and 46, respectively, and spine 48 connecting the cover flaps to each other. The cover may be of any desirable material such as cardboard, plastic, or metal, and can be decorated with desired ornamental designs such as a vinyl or leather finish, or some other finish for the desired appearance. The interior of the album includes at least one leaf having a fusible portion, preferably a plastic pocket 50 for containing photographs. If display of the photographs is desired, the pocket material can be chosen to be a transparent plastic so as to allow viewing of the photographs carried within the pockets.

As shown in FIG. 4, each pocket is preferably constructed from two rectangular sheets of plastic which are joined at three edges 52, 54 and 56 thereby to form an opening 58 at the top edge 60 for receiving a photograph (not shown). The pockets 50 are joined at their edges 56 (by fusing as discussed below) adjacent the spine 48 of the album cover 42. More particularly, the portion of the pockets 50 adjacent to edge 56 comprise a fusible material and are fused together to a binder element such as a binder strip 62 a portion of which also comprises fusible material. The fused portion of the leaves and the fused portion of the binder strip thus form a hinge 64 which allows pivotable movement of the pockets about the hinge 64 when the binder strip is attached to the spine 48.

Figure 5:
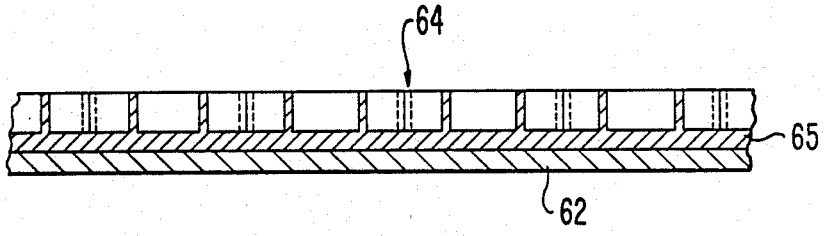
FIG. 5 is a cross sectional view of one embodiment of the fused hinge portion of the leaves of the album of the present invention.
Figure 6A:
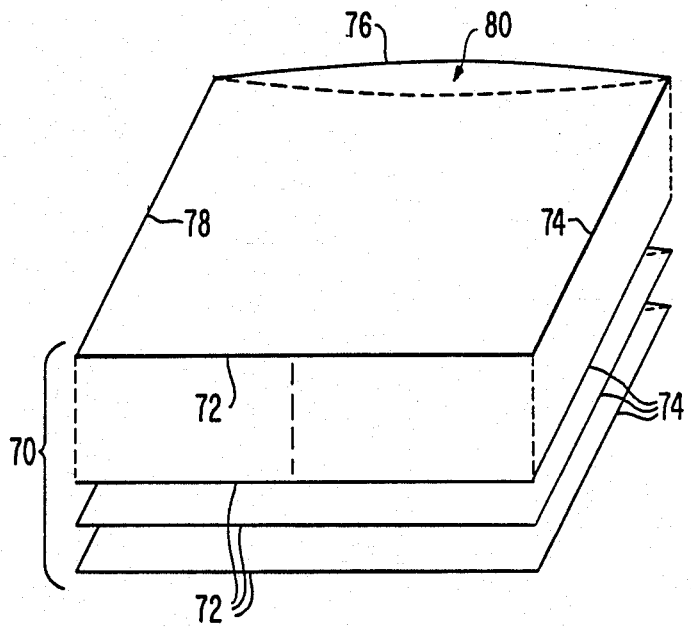
FIGS. 6*a* through 6*d* illustrate exemplary steps of a method of binding leaves to an album cover according to one embodiment of the present invention.
Figure 6B:
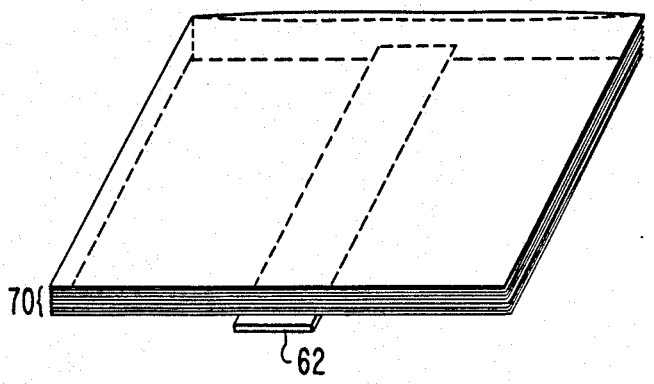
Figure 6C:
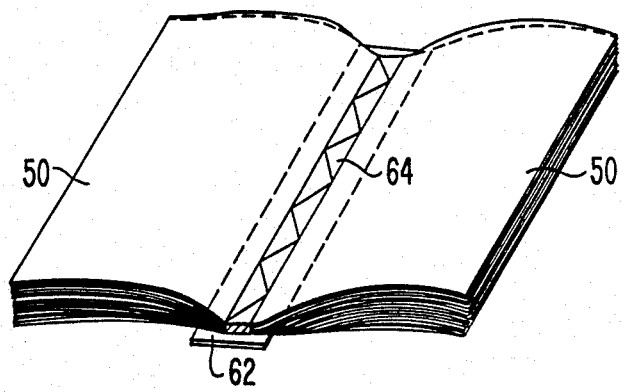
Figure 6D:
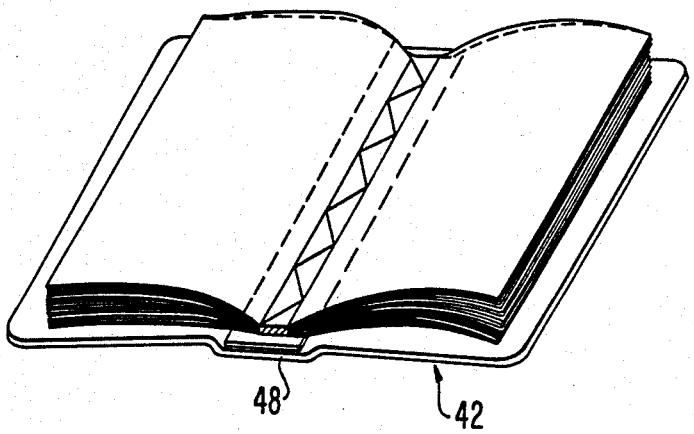

One embodiment of the hinge 64 is more clearly shown with more details in FIGS. 4 and 5. The portion of each pocket 50 adjacent edge 56 is fused together into a structure 65 having indentations. The pockets 50 are pivotable about the hinge 64 as the pockets 50 are turned like pages in a book. An advantage of the indented structure of hinge 64 will be apparent after the description below of a method for constructing the photograph album. The particular pattern of indentations results from the tool used to form the structure 65 in the method described below. The indentation pattern shown in FIG. 4 has an appearance of a zig-zag stitch pattern. Some methods may result in a smooth hinge appearance.

FIGS. *6a–d* illustrate the steps in a preferred method of constructing the photograph album described above of the type in which plastic pockets are fused to a binder strip. In FIG. *6a*, a plurality of plastic envelopes 70 are stacked in a pile with the edges 72, 74, 76 and 78 of the plastic envelopes aligned. Each plastic envelope 70 is approximately twice the size of a pocket 50 shown in FIG. 4. Edges 72, 74 and 78 are sealed and an opening 80 is formed along edge 76. A binder strip 62 is preferably placed below the stack of plastic envelopes 70 as shown in FIG. *6b*.

The next step is to fuse a portion of the plastic envelopes 70 with a portion of the binder strip 62 to form a hinge 64. Fusing technique is well known in the art. In general, heat is applied to the portion of the plastic to be fused while pressure is applied to compress the portion to form a fused structure. One of the ways to perform such a task is to use a jaw member (not shown) having protrusions matching the desired indentations such as those of the indented structure 65 previously described, and an anvil (not shown). The portion of the plastic envelopes 70 to be fused and the binder strip 62 are compressed between the jaw member and the anvil with the jaw member touching the plastic envelopes 70. At the same time, heat is applied to the jaw member and/or the anvil. The portion of the plastic envelopes 70 between the jaw member and the anvil is softened by the heat from the jaw member. The softened plastic which is under pressure between the jaw member and the anvil flows to conform to the shape and the pattern of the protrusions on the jaw member. The softened portions of the plastic envelopes 70 under the jaw member are pressed together whereby the individual layers of plastic envelopes 70 under the jaw member are fused together into an integral structure. At the same time, the binder strip 62 is also softened by the heat. The pressure between the jaw member and the anvil compress the fused portion of the envelopes 70 against the binder strip 62 to form a fused bonding connection between the plastic envelopes 70 and the binder strip 62. The jaw member is maintained at a temperature such that the fusible portion of the plastic envelopes and binder element will not be burnt but which is just enough to soften and fuse the layers of plastic.

The jaw member is then removed and the fused plastic is allowed to cool. The fused plastic hardens upon cooling to form a structure integral with the binding strip 62. As shown in FIG. *6c*, the hinge 64 separates each plastic envelope 70 into two pockets 50, one on each side of the fused hinge 64. For purpose of example, and not by way of limitation, if the plastic envelopes are each 7.0 inch by 5.0 inch with the opening along the longer edge, the binder strip 62 is placed at mid-length to form pockets of size approximately 3.5 inch by 5.0 inch with 3.5 inch openings. The pockets 50 can be turned like leaves of a book about the fused hinge 64.

Figure 7:
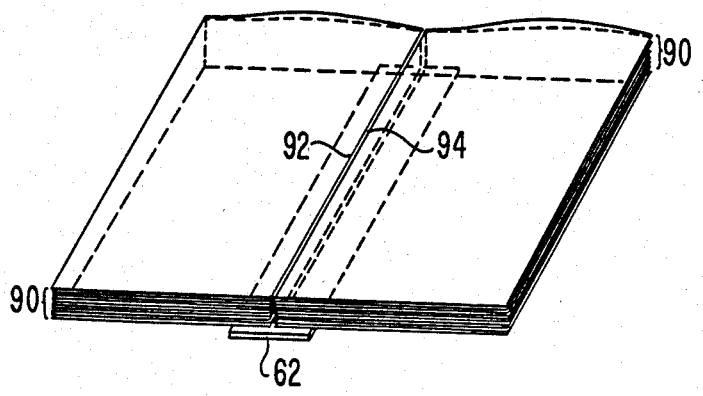
FIG. 7 illustrates an arrangement of leaves in a method of binding leaves to an album cover according to another embodiment of the present invention.

Alternatively, refering to FIG. 7, instead of employing envelopes 70 which have openings 80 twice as long as the openings 58 of the pockets 50, the pockets may be formed by employing envelopes 90 similar in form as envelopes 70 but which are approximately the same size as the pockets 60. These envelopes are arranged in two stacks side by side and preferably with adjacent sides 92 and 94, respectively, of the stacks adjoining each other. The binder strip 62 is preferably placed below the stacks along the adjoining sides 92 and 94. The envelopes may be fused to the binder strip in a similar manner described above to form an album.

It is desirable (although not essential to the present invention) to have indentations within the hinge 64 for at least two reasons. The pattern of the indentations may be aesthetically appealing to a person browsing through the album. The pattern can be made to resemble a hand sewn stitch pattern to simulate an expensive hand-crafted album. Second, the indented structure is also more durable than a smooth structure without indentations in holding the leaves together.

Referring to FIG. *6d*, the hinge 64 together with pockets 50 is attached, for example using glue, to an album spine 48 to form a photograph album 42 such as shown in FIGS. 3 and 4. Other methods of attachment are within the scope of this invention.

Figure 1:
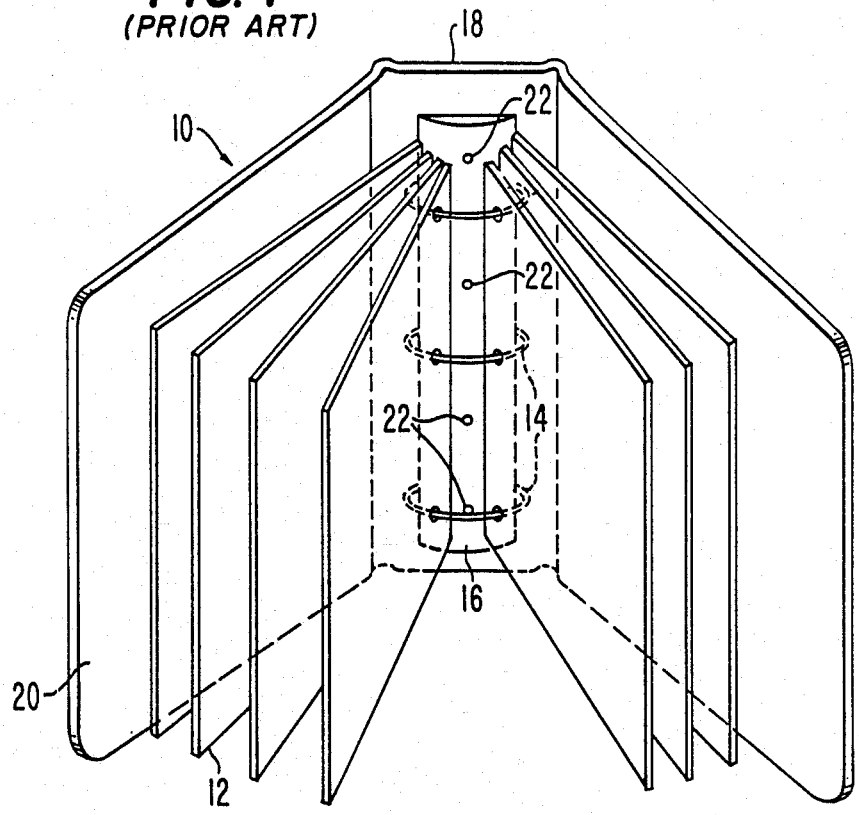
FIG. 1 (PRIOR ART)
FIG. 1 is a perspective view of a prior art photograph album having a ring binder.
Figure 2:
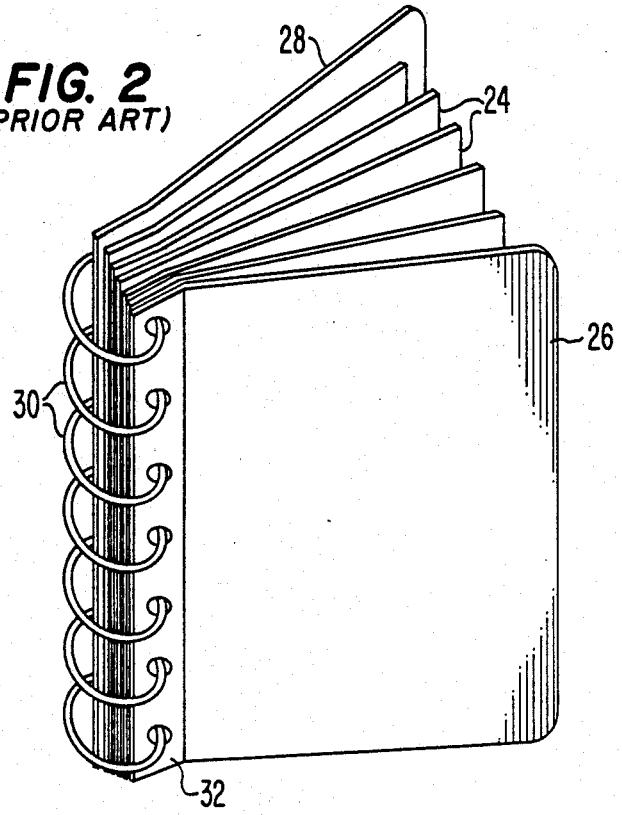
FIG. 2 (PRIOR ART)
FIG. 2 is a perspective view of a prior art photograph album having a different type of ring binder.

What has been described above is a novel album for containing graphics for display and a method for binding the album. The structure of the album is simple, and is therefore inexpensive to manufacture. The album is light because the binding along the spine of the album is compact as compared to a metal ring binder element such as that shown in FIG. 1. The overall size of the album can be kept to a minimum because the album cover can be made substantially the same size as the leaves and the width of the spine can be kept to a minimum absent the bulkiness of a ring binder. A compact pocket-size album can be formed which can be carried in a person's coat pocket.

In addition, the appearance of the album of the present invention is improved over albums of the type which uses a metal ring binder element that is attached to the spine of the album cover with rivets. No rivets are required to attach the above described plastic binder element to the spine. Therefore, the album cover appears as a typical bound book without rivets showing on the spine which otherwise has been found to be undesirable. Moreover, no glue is used to connect the plastic pockets to the binder element and thus the bonding between the pockets and the binder element is very durable against stresses at the hinge. The binder element together with the plastic pockets may be glued to any desired cover in the final manufacturing step of the album.

It should be noted that the invention is not limited to the embodiments described above. Each leaf may comprise more than one pocket along the plane of the leaf. The openings of the pockets may be located along any edge of the pockets. The pockets may be transparent, translucent or opaque depending on whether display of the contents carried in the pockets is desired. Instead of pockets, each leaf may be a sheet, without pockets, on which articles may be attached. The album may take on other shapes and the hinge may have indentations arranged in a different pattern. The album cover may be made of leather or vinyl in a shape resembling a bound book. Ornamental features may be added to the basic structure of the album as desired.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

I claim:

1. An album comprising:

a cover;

a plastic binder element attached to said cover and having a thermally fusible region facing inwardly of said cover; and a plurality of leaves each having a portion which is aligned with said thermally fusible region and which consists essentially of thermally fusible plastic material throughout the length of said leaf portion, wherein two adjacent leaves are joined together along three edges to form a pocket having an opening for receiving articles to be contained in the pocket, one of said two leaves is a transparent plastic, and said thermally fusible region and said thermally fusible material of each said leaf are permanently thermally fused together to define a hinge about which all of said leaves may be turned.

2. an album as defined in claim 1 wherein said thermally fusible region of said binder element and said thermally fusible material of all of said leaf portions are fused together so that the hinge has a pattern composed of indentations.

* * * * *